United States Patent [19]

Yoshimi et al.

[11] 4,418,632

[45] Dec. 6, 1983

[54] METHOD FOR OPERATING A RIGID MARINE SAIL

[75] Inventors: Kazuhiko Yoshimi, Yokohama; Kazuyuki Shimizu, Fujisawa; Takashi Watari, Kamakura; Katsunori Kusumoto, Yokosuka, all of Japan

[73] Assignees: Nippon Kokan Kabushiki Kaisha; Japan Marine Machinery Development Association, both of Tokyo, Japan

[21] Appl. No.: 258,543

[22] Filed: Apr. 28, 1981

[51] Int. Cl.[3] ..... B63H 9/06

[52] U.S. Cl. ..... 114/102; 114/39

[58] Field of Search ..... 114/39, 102, 103, 104

[56] References Cited

U.S. PATENT DOCUMENTS 3,934,533 1/1976 Wainwright ..... 114/39

FOREIGN PATENT DOCUMENTS 1013642 2/1950 France .
2354239 1/1978 France ..... 114/102
55-47994 4/1980 Japan .
1410175 2/1982 United Kingdom .

OTHER PUBLICATIONS

Marine Engineers Review, Oct. 1980, Warley, West Midlands, GB "Japan Launches First Wind-Assisted Ship", p. 19.

New York Times Magazine Section, Dec. 6, 1981, "A Fresh Wind for Sail Power" by Joanne A. Fishman.

*Primary Examiner*—Trygve M. Blix
*Assistant Examiner*—Thomas J. Brahan
*Attorney, Agent, or Firm*—Frishauf, Holtz, Goodman and Woodward

[57] ABSTRACT

A rigid marine sail has a rigid left sail portion and a rigid right sail portion, both of which are pivotally secured to a mast on a ship so as to be pivotable about one common pivot axis which extends substantially parallel to the mast of the ship. The common pivot axis is spaced ahead of the mast with respect to the direction of intended movement of the ship. The left and right sail portions are foldable to an operable position by pivoting them about the common pivot axis and are also foldable to a streamlined folded inoperable position by being pivoted about the one common pivot axis, the left and right sail portions being substantially parallel to each other and closely facing each other when they are in their streamlined folded inoperable positions. A shroud is provided ahead of the common pivot axis with respect to the direction of movement of the ship. When the left and right sail portions are in their folded inoperable position, the shroud spans a gap between them to reduce air resistance. When the sail portions are unfolded to their operable positions, only the left and right sail portions serve as sail members and they also shield the shroud from exposure to the wind.

2 Claims, 9 Drawing Figures

METHOD FOR OPERATING A RIGID MARINE SAIL

REFERENCE TO PATENTS, APPLICATIONS AND PUBLICATIONS PERTINENT TO THE INVENTION

The following prior document is pertinent to the present invention:

Japanese Patent Provisional Publication No. 47,994/80 dated Apr. 5, 1980.

The contents of the prior art disclosed in the above-mentioned prior art document will be described later under the caption BACKGROUND OF THE INVENTION.

FIELD OF THE INVENTION

The present invention relates to a method for folding a rigid marine sail, which is fitted to a ship for effectively utilizing wind force on a voyage of the ship, so that the rigid sail has a streamlined cross-sectional shape, thereby permitting minimization of wind resistance on a voyage under calm conditions.

BACKGROUND OF THE INVENTION

It has recently been proposed to mount one or more sails on an engine-driven ship for effectively utilizing wind force on a voyage of the ship with a view to saving energy. A conceivable sail to be mounted on a ship is the conventional sail made of canvas fitted to the mast. Such a sail requires much time and labor for spreading and furling the sail.

To avoid this inconvenience, a sail comprising thin metal plates or synthetic resin plates applied to reinforced rib members (hereinafter simply referred to as a rigid sail) was invented to take the place of the above-mentioned canvas sail. Since this rigid sail can automatically be opened and closed, it permits solving the above-mentioned problem.

As shown in FIG. 1, the present inventors have previously proposed the following sail as one of the above-mentioned rigid sails, the prior sail being disclosed in Japanese Patent Provisional Publication No. 47,994/80 dated Apr. 5, 1980, hereinafter referred to as "prior art". Said prior art sail comprises:

a mast 2 vertically fitted through a mast support (not shown) onto the deck of a ship 1; said vertical mast 2 being rotatable around the axis thereof;

a rigid sail 4 fitted to said mast 2 in parallel with the axis thereof; said rigid sail 4 comprising a central sail portion 4A fixed through a fixture 3 to said mast 2, and a left sail portion 4B and a right sail portion 4C both fixed to the respective side edges of said sail portion 4A so as to permit opening and closing motions of the rigid sail portions 4B and 4C;

cylinders 5A and 5B for opening and closing said left sail portion 4B and said right sail portion 4C;

whereby said sail portions 4B and 4C are opened and closed relative to said mast by actuating said cylinders 5A and 5B.

However, since the rigid sail in the above-mentioned prior art is folded to form a triangular cross-sectional shape, the rigid sail may create a high wind resistance on a voyage under calm conditions, even when in its folded state.

SUMMARY OF THE INVENTION

A principal object of the present invention is therefore to provide a method for folding a rigid marine sail, which is fitted to a ship for effectively utilizing wind force on a voyage of the ship, so that the rigid sail may be folded into a shape permitting minimization of wind resistance on a voyage under calm conditions.

DETAILED DESCRIPTION OF PREFERRED EMBODIMENTS

With a view to solving the above-mentioned problem involved in the prior art, i.e., the rigid sail still being exposed to a high wind resistance even in the folded state, we carried out extensive studies. As a result, we discovered that the above-mentioned problem could be solved by a new method for folding the rigid sail so as to give a streamlined cross-sectional shape.

Now, the rigid marine sail in an embodiment of the method of the present invention is described with reference to the drawings.

Figure 1:
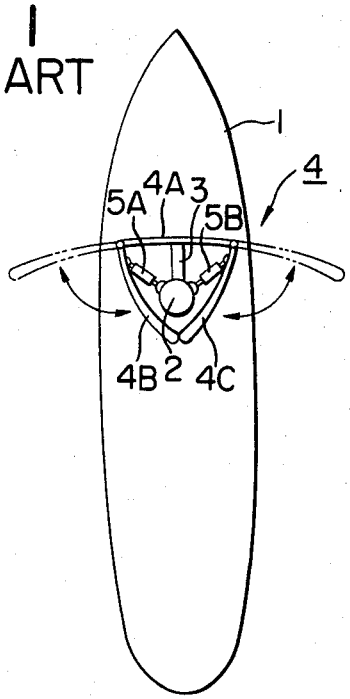
FIG. 1 PRIOR ART
FIG. 1 is a plan view illustrating the opened and closed states of the rigid marine sail of the prior art.
Figure 3:
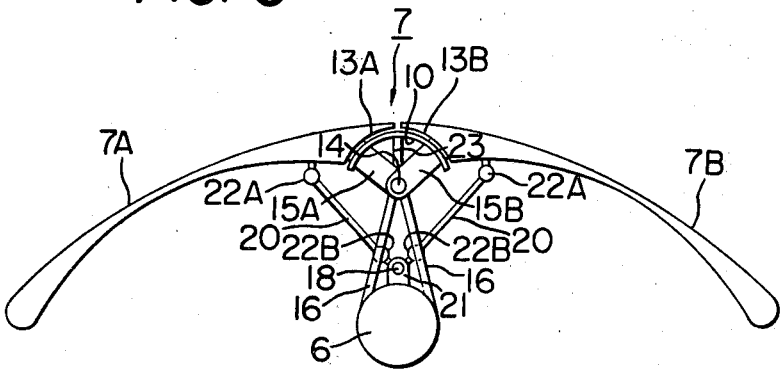
FIG. 3 is a plan view illustrating the rigid marine sail in the opened state in an embodiment of the method of the present invention.
Figure 2:
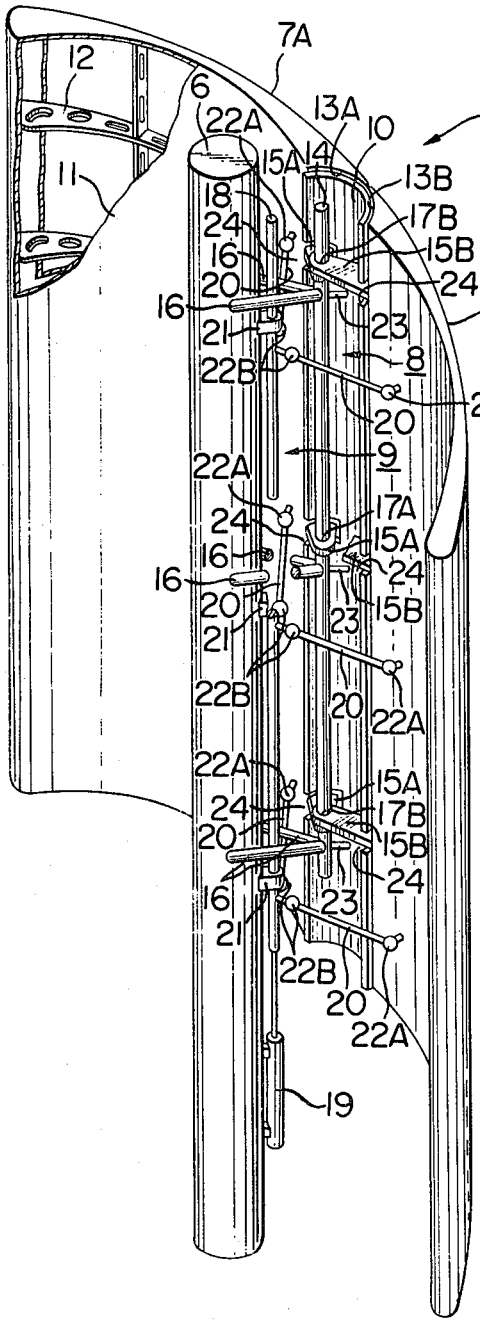
FIG. 2 is a partially cutaway perspective view illustrating the rigid marine sail in the opened state in an embodiment of the method of the present invention.

In FIGS. 2 and 3, a mast 6 is fitted vertically to the deck of a ship through a mast support described later; 7 is a rigid sail comprising two sail portions 7A and 7B which are fitted to the mast 6 symmetrically so as to permit the opening and closing motions of the rigid sail 7, one side edge of each of the sail portions 7A and 7B being adjacent to each other; 8 is a fitting mechanism for supporting the sail portions 7A and 7B at the above-mentioned one side edge of each of the sail portions 7A and 7B so as to permit the opening and closing motions of the rigid sail 7 relative to the mast 6; 9 is an opening/-closing mechanism for opening and closing the sail portions 7A and 7B symmetrically relative to the mast 6; and 10 is a shrouding plate.

The sail portions 7A and 7B are symmetrical in shape with each other, which form respective curved portions, and comprise thin plates 11 (FIG. 2) made of a metal or a synthetic resin and ribs 12 assembled in a lattice shape for reinforcing the thin plates 11. The said portions 7A and 7B are provided with inwardly curved arcuate surfaces 13A and 13B meeting the shrouding plate 10 in the longitudinal direction of the above-mentioned one side edge of the sail portions 7A and 7B.

The fitting mechanism 8, FIG. 2, comprises a fitting axle 14 and a plurality of brackets 15A and 15B. The fitting axle 14 is fixed to the mast 6 through a plurality of fixtures 16 in parallel with the mast 6, and has a length substantially equal to the longitudinal length of the rigid sail 7. The brackets 15A and 15B are fixed at an end thereof to the respective curved surfaces 13A and 13B of the sail portions 7A and 7B at predetermined intervals in a vertical direction. At the other ends of the brackets 15A and 15B, holes 17A and 17B for passing the fitting axle 14 are provided so that the brackets 15A and 15B are pivotable about the fitting axle 14. Thus the sail portions 7A and 7B are supported by the brackets 15A, 15B and the fitting axle 14 passing through the holes 17A and 17B of the brackets 15A and 15B so as to permit the opening and closing motions of the sail portions 7A and 7B relative to the mast 6.

Figure 4:
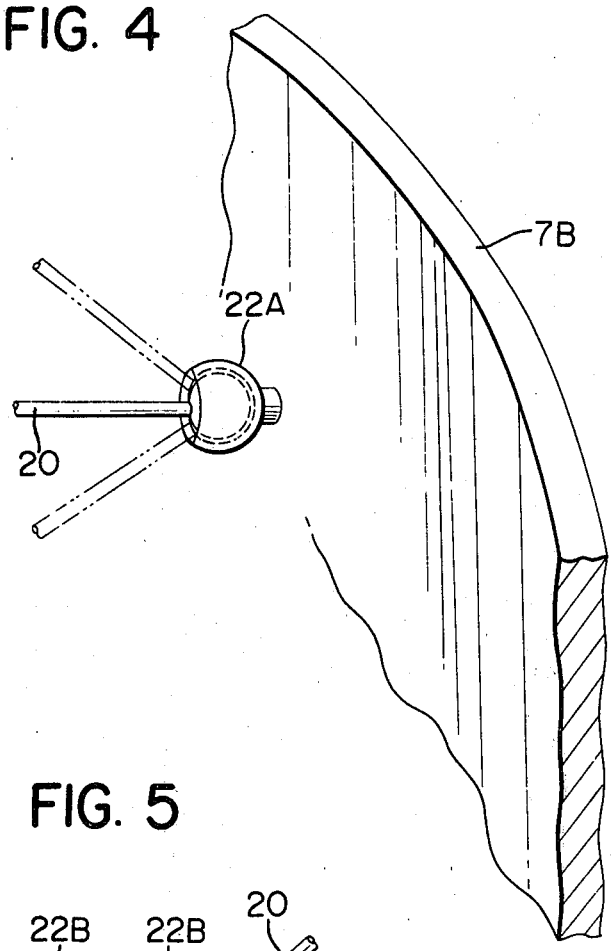
FIG. 4 is a partially cutaway perspective view illustrating a fitting construction of the rigid marine sail and a universal bearing in an embodiment of the method of the present invention.
Figure 5:
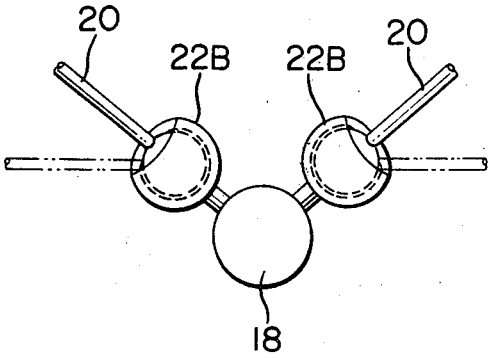
FIG. 5 is a partially cutaway plan view illustrating a fitting construction of the movable rod of the rigid marine sail and the universal bearing in an embodiment of the method of the present invention.
Figure 6:
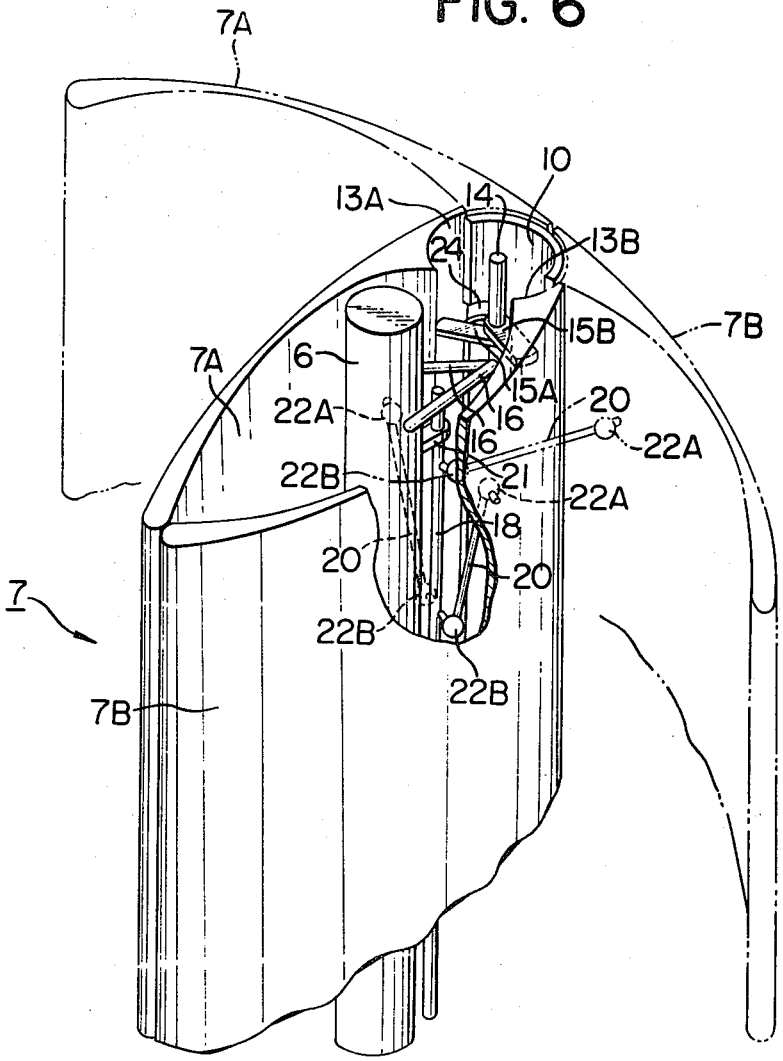
FIG. 6 is a partially cutaway perspective view illustrating the opened and closed states of the rigid marine sail in an embodiment of the method of the present invention.
Figure 7:
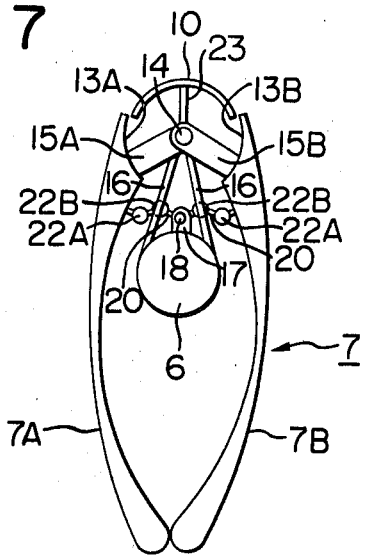
FIG. 7 is a plan view illustrating a rigid marine sail in the closed state in an embodiment of the method of the present invention.

The opening/closing mechanism 9 comprises a movable rod 18, a lift means 19 and connecting rods 20. The movable rod 18 is fitted to the mast 6 through a plurality of guide members 21 so as to be vertically movable in parallel with the mast 6. The lift means 19 is to cause vertical movement of the movable rod 18, comprises a cylinder, and is fixed to the lower part of the mast 6. The connecting rods 20 are provided at predetermined intervals in a vertical direction near the curved surfaces 13A and 13B of the sail portions 7A and 7B. Ends of one side of the rods 20 are connected to the portions near the curved surfaces 13A and 13B of the sail portions 7A and 7B through respective universal bearings or joints 22A at predetermined intervals in a vertical direction (see FIG. 4). The ends of the other side of the rods 20 are connected to the rod 18 through the other respective universal bearings or joints 22B at predetermined intervals in a vertical direction (see FIG. 5). Thus, the movable rod 18 is vertically driven by actuating said lift means 19, whereby the sail portions 7A and 7B are opened and closed around the fitting axle 14 through the actions of the movable rod 18 and the plurality of connecting rods 20. The opening and closing motions of the sail portions 7A and 7B are symmetrical relative to the mast 6 (see FIGS. 6 and 7).

The shrouding plate 10 is fixed to the fitting axle 14 through a plurality of fixing rods 23 in parallel with the fitting axle 14 in front of the same relative to the mast 6. The shrouding plate 10 has the same length as the longitudinal length of the sail portions 7A and 7B, as has a semi-cylindrical shape. On both side edges of the shrouding plate 10, a plurality of notches 24 are provided at predetermined intervals in the vertical direction, and the plurality of brackets 15A and 15B are fixed at ends thereof to one side edges of the curved surfaces 13A and 13B after passing through the respective notches 24. Thus, the shrouding plate 10 covers the gap between the side edges of the respective curved surfaces 13A and 13B of the sail portions 7A and 7B, which gap is produced when the sail portions 7A and 7B are closed relative to the mast 6.

The shrouding plate 10 is not always necessary, but it is possible, by providing the shrouding plate 10, to keep a more perfectly streamlined cross-sectional shape of the rigid sail 7 in a state where the sail portions 7A and 7B are closed.

Now, the above-mentioned mast support is described in the following paragraphs.

Figure 9:
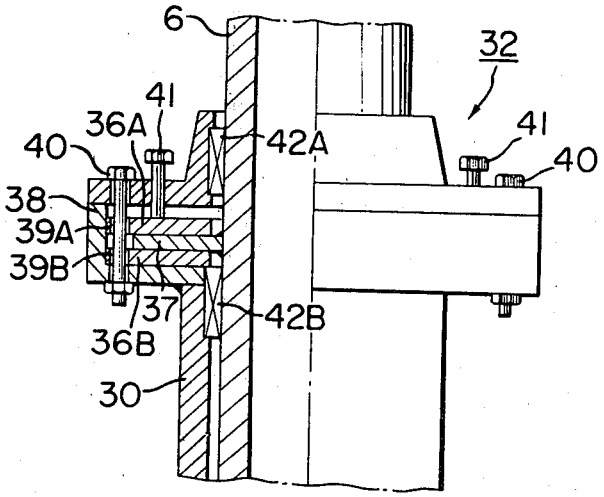
Figure 8:
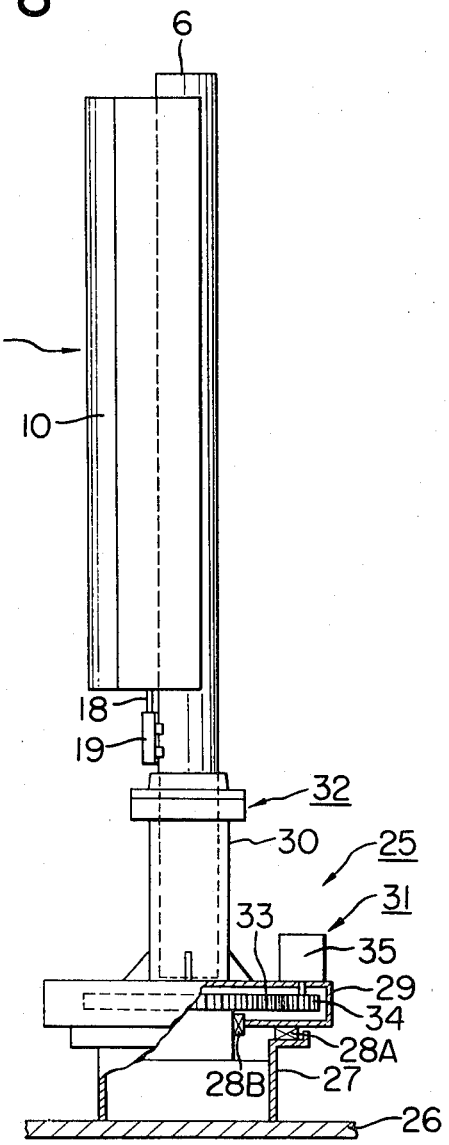
FIG. 8 is a partially cutaway side view of the rigid marine sail in an embodiment of the method of the present invention; and, FIG. 9 is a partial sectional front view illustrating the mast fixing mechanism of the rigid marine sail in an embodiment of the method of the present invention.

As shown in FIGS. 8 and 9, the mast support 25 comprises: a rotating base 29 fitted through bearings 28A and 28B onto a fixed base 27 which is fixed onto the deck 26; a mast supporting cylinder 30 fixed through bearings 42A and 42B vertically onto the rotating base 29 for supporting the lower end of the mast 6; a rotation control means 31 for controlling rotation of the rotating base 29; and, a mast fixing mechanism 32 fitted to the upper end of the mast supporting cylinder 30.

The rotation control means 31 comprises: a fixed gear 33 fixed horizontally in the rotating base 29; a rotating gear 34 meshing with the fixed gear 33; and, a motor 35 provided on the rotating base 29 for rotating the rotating gear 34. Thus, by actuating the motor 35, the rotating base 29 is rotatively and horizontally driven relative to the fixed base 27 through the gearing of the gears 33 and 34, and this causes the mast 6 to rotate integrally with the mast supporting cylinder 30.

The mast fixing mechanism 32 comprises: a pair of annular fixed friction plates 36A and 36B; and, a rotating friction plate 37. The fixed friction plates 36A and 36B and the rotating friction plate 37 are provided in an enlarged portion 38 provided on the top of the mast supporting cylinder 30. The fixed friction plates 36A and 36B are provided with a plurality of through-holes 39A and 39B at predetermined intervals in the circumferential direction thereof, and are horizontally fixed to the inner surface of the enlarged portion 38 by a plurality of through-bolts 40 passing through these holes 39A and 39B. The rotating friction plate 37 is horizontally fixed to the outer surface of the mast 6, and is sandwiched between the fixed friction plates 36A and 36B. The fixed friction plates 36A and 36B are mutually fixed by tightening a plurality of pressure bolts 41 screwed into the upper wall of the enlarged portion 38, and are mutually released by loosening the plurality of pressure bolts 41. Thus, the mast 6 is fixed to the mast supporting cylinder 30 by tightening the plurality of pressure bolts 41, and is released relative to the mast supporting cylinder 30 by loosening the plurality of pressure bolts 41. Therefore, when the rigid sail 7 is exposed to wind resistance in a closed state where the sail portions 7A and 7B are closed, the rigid sail 7 rotates around the mast 6 depending upon the wind direction toward the direction in which the shrouding plate 10 becomes opposite to the wind direction. This is because the mast 6 locates eccentrically near the shrouding plate 10 side of the rigid sail 7 in the closed state where the sail portions 7A and 7B are closed. As a result, it is possible to always minimize the wind resistance to which the rigid sail 7 is exposed, irrespective of the wind direction.

According to the method of the present invention, as described above in detail, it is possible to fold a rigid sail so as to give a streamlined cross-sectional shape, and thus to minimize the wind resistance to which the rigid sail is exposed on a voyage under calm conditions, thus providing industrially useful effects.

What is claimed is:

1. Method for operating a rigid marine sail having a rigid left sail portion and a rigid right sail portion, each of said rigid left and right sail portions having an inboard end and an outboard end, comprising:

providing a mast on a ship;

pivotally securing said left and right sail portions to said mast so as to be pivotable about one common pivot axis which extends substantially parallel to said mast, said one common pivot axis being spaced ahead of said mast with respect to the direction of intended movement of the ship;

selectively extending said left and right sail portions to an unfolded operable position by controllably pivoting said left and right sail portions about said one common pivot axis and selectively folding said left and right sail portions to a streamlined folded inoperable position by controllably pivoting said left and right sail portions toward each other about said one common pivot axis so as to locate said mast between said left and right sail portions when said left and right sail portions are at said folded inoperable position, said left and right sail portions when being at said folded inoperable position defining an essentially closed wing-shaped streamlined member wherein the inboard ends of said left and right sail portions are close to each other and face each other and the outboard ends of said left and right sail portions closely face each other to present a substantially streamlined form.

2. The method of claim 1, comprising:

providing a shroud means ahead of said one common pivot axis with respect to the direction of intended movement of said ship and between said left and right sail portions;

substantially spanning a gap between said left and right sail portions by said shroud means when said left and right sail portions are folded to said folded inoperable position, said left and right sail portions being substantially parallel to each other when folded to said foled inoperable position, said shroud means and said left and right sail portions when folded to said folded inoperable position presenting a streamlined cross-sectional shape to reduce air resistance; and covering substantially all of said shroud means with at least part of said left and right sail portions when said left and right sail portions are extended to said unfolded operable position, in which unfolded operable position said left and right sail portions serve as a sail for said ship and shield said shroud means from exposure to wind.

* * * * *